United States Patent [19]

Miller et al.

[11] 4,349,816

[45] Sep. 14, 1982

[54] DRIVE CIRCUIT FOR MATRIX DISPLAYS

[75] Inventors: M. Robert Miller, Neptune; Richard P. Tuttle, Wall, both of N.J.

[73] Assignee: The United States of America as represented by the Secretary of the Army, Washington, D.C.

[21] Appl. No.: 248,666

[22] Filed: Mar. 27, 1981

[51] Int. Cl.[3] ..... G09G 3/30

[52] U.S. Cl. ..... 340/781; 315/169.3; 340/825.81; 340/752

[58] Field of Search ..... 340/781, 825.81; 315/169.3

[56] References Cited

U.S. PATENT DOCUMENTS

| | | | |
|---|---|---|---|
| 3,163,851 | 12/1964 | De Haan et al. | 340/781 X |
| 3,311,781 | 3/1967 | Duinker et al. | 340/825.81 X |
| 3,665,246 | 5/1972 | Kurahashi et al. | 315/169.3 |
| 3,765,011 | 10/1973 | Sawyer et al. | 340/825.81 X |

*Primary Examiner*—David L. Trafton

*Attorney, Agent, or Firm*—Nathan Edelberg; Jeremiah G. Murray; Michael C. Sachs

[57] ABSTRACT

Disclosed is a capacitive voltage divider drive circuit for electroluminescent matrix displays comprised of, for example, thin film electroluminescent capacitance type elements. The drive circuit for each display element, which exhibits a relatively low capacitance, includes a relatively large series connected capacitor which couples a drive voltage thereacross upon the closure of a first switching element. Due to voltage divider action, a relatively greater portion of the drive voltage appears across and energizes the display element by exceeding its threshold voltage. Additionally, another relatively large capacitor is coupled in parallel with the display element upon the closure of a second switching element which, again due to voltage divider action, reduces the drive voltage thereacross below its energizing threshold level to deenergize it. The switching elements are comprised of semiconductor switch devices which are adapted to operate in timed relationship with a resonant AC drive voltage applied to the matrix. A plurality of row and column electrodes form the capacitive type display elements. Moreover, each row electrode in the matrix is connected to a respective first switching element while each column electrode is connected to a respective series capacitor as well as a respective parallel capacitor and second switching element.

14 Claims, 7 Drawing Figures

DRIVE CIRCUIT FOR MATRIX DISPLAYS

The invention described herein may be manufactured, used, and licensed by or for the Government for governmental purposes without the payment to me of any royalties thereon.

BACKGROUND OF THE INVENTION p This invention relates to electronic displays and more particularly to a means for driving the elements in electroluminescent matrix type of display.

Thin film electroluminescent displays consisting of electroluminescent capacitive type elements are known to those skilled in the art. The luminous efficiency, which is defined as the light output per unit of power actually dissipated, presently is in the range of 1 to 5 lumens per watt. This power, however, represents only a small fraction of the total power dissipated in charging and discharging the panel capacitance when the driving power supply has a real (resistive) impedance. One known method to circumvent this excessive power loss is to utilize a resonant power supply to recover the energy stored in display capacitance and to use it for the next cycle. The problem which presents itself is how to connect a resonant circuit through switching circuitry to hundreds of rows and column leads of a matrix display. It is to this problem that the present invention is directed.

Accordingly, it is an object of the present invention to provide an improved means of driving an electronic display.

It is another object of the present invention to provide a means for driving an electroluminescent matrix type of display.

Still another object of the present invention is to provide a means of driving an electronic display for alpha-numeric, graphic and video applications powered from a resonant power supply circuit.

And yet another object of the present invention is to provide an improved means for driving matrix displays which reduces power consumption, simplifies drive circuitry and eliminates unintentional energization of undesired elements in the display.

Still yet another object of the present invention is to provide an improved means of driving capacitive type electroluminescent display elements of a matrix display taking into account the capacitive coupling of all the rows and columns of the display.

SUMMARY

These and other objects of the present invention are achieved by means of a capacitive voltage divider circuit configuration for coupling power to a matrix display comprised of capacitive type electroluminescent elements. The electroluminescent elements in the display are formed at the crossing of rows and columns of transparent electrodes in a thin film structure. The drive circuit for each display element in the matrix includes a relatively large series connected capacitor which couples a drive voltage thereacross upon the closure of a first switching element which due to voltage divider action energizes the display element by exceeding its threshold voltage and a relatively large capacitor which is additionally coupled in parallel with the display element upon the closure of a second switching element which, again due to voltage divider action, reduces the drive voltage across the display element below its energizing threshold, causing it to become deenergized. In the matrix configuration, a first switching element is connected to each row electrode while respective series and parallel capacitors along with a second switching element is connected to each column electrode with the individual first and second switching elements being selectively opened and closed to energize any number of electroluminescent elements desired. The switching elements, moreover, are comprised of semiconductor switch devices which are adapted to be operated in timed relationship with a resonant power supply which applies a sinusoidal voltage to the matrix of display elements.

DESCRIPTION OF THE PREFERRED EMBODIMENT

Figure 1:
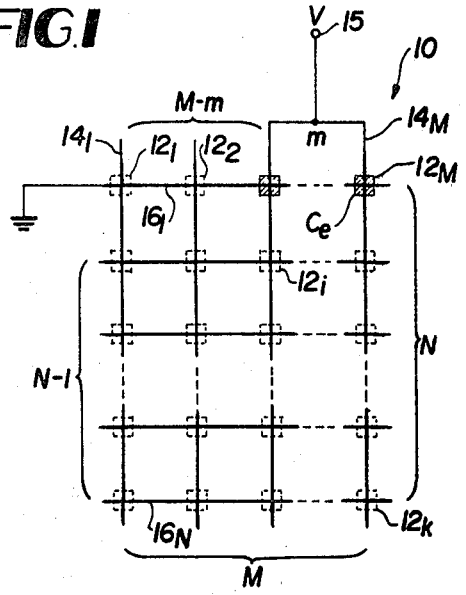
FIG. 1 is a schematic diagram generally illustrative of a matrix of thin film electroluminescent capacitive type display elements.

Referring now to the drawings and more particularly to FIG. 1, reference numeral 10 denotes a matrix of a plurality (M×N) of light emitting elements $\mathbf{12}_1 \ldots \mathbf{12}_k$ formed of thin film electroluminescent capacitance type elements formed at the crossing of M columns and N rows of electrodes $\mathbf{14}_1 \ldots \mathbf{14}_M$ and $\mathbf{16}_1 \ldots \mathbf{16}_N$, each having a capacitance of $C_e$. Upon the application of a drive voltage V, appearing at terminal 15, across any column conductor $\mathbf{14}_i$ and row conductor $\mathbf{16}_i$ the threshold value of the capacitance element $\mathbf{12}_i$ will be exceeded whereupon light energy (EL) will be radiated from that particular element.

Figure 2:
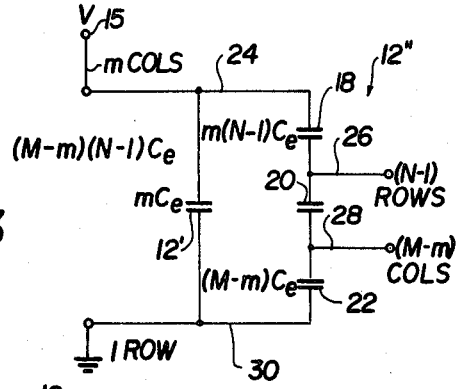
FIG. 2 is an electrical schematic diagram of the equivalent circuit for the matrix shown in FIG. 1.

What is desired in the subject invention is a drive circuit that will select one of N rows and turn on m number of the M elements 12 in that row. As shown in FIG. 1, by applying the V drive voltage to terminal 18 which is connected to m columns while row 1 electrode is grounded, the devices $\mathbf{12}_{m-1}$ and $\mathbf{12}_m$ are energized. The resulting equivalent circuit is shown in FIG. 2 and constitutes a capacitance 12' having a value of $mC_e$ shunted by a capacitance 12'' comprised of three series capacitances 18, 20 and 22 having the values of m $(N-1)C_e$, $(M-m)(N-1)C_e$, and $(M-m)C_e$, respectively. If, however, the leads to the unenergized N−1 rows and M−m columns, as shown by the leads 26 and 28, are allowed to float, the voltage across the M−m unenergized capacitive type elements 12 will exceed the threshold level for any practical display medium such as utilized in thin film electroluminescence displays as soon as m reaches a sizable fraction of M. Owing to the capacitive nature of the matrix 10, a pulse drive system such as used in many present applications is very inefficient due to the $CV^2/2$ energy loss every time the array is switched between voltage levels. Drive systems that maintain the unenergized elements at a voltage below threshold generally become relatively complex and normally requires additional sophisticated circuitry having control signals floating on relatively high level drive voltages rather than being referenced to ground as desired.

Figure 3:
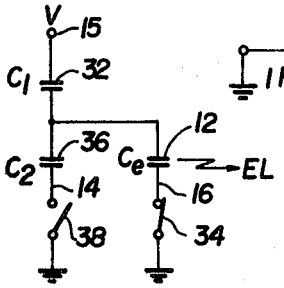
FIG. 3 is an electrical schematic diagram of a basic drive circuit in accordance with the subject invention for each of display elements in the matrix shown in FIG. 1.

The present invention overcomes the deficiencies of the prior art by a capacitive voltage divider drive circuit which in its simplified form is as shown in FIG. 3. Shown is one matrix element 12 which has associated with it a relatively small capacitance $C_e$. A first relatively large capacitance $C_1$ having a reference numeral 32 is connected in series with the display element 12 across the drive potential V upon the closure of a series connected electrical switch element 34. A second relatively large capacitor $C_2$ and having a reference numeral 36 is connected in parallel with the display element 12 upon the closure of a second electrical switch element 38. Since the capacitance value of the series capacitor $C_1$ and the parallel capacitor $C_2$ are large compared to the value $C_e$, upon the closure of switch 34 while the switch 38 remains open, the display element 12 will see a voltage $V(C_1/C_1+C_e)$ which if the proper values are chosen, will exceed the threshold value of the matrix display element 12 causing it to emit electroluminescent (EL) radiation. Upon the closure of the switch element 38, however, the capacitance $C_2$ of capacitor 36 will dominate and the voltage appearing across the capacitance $C_3$ will be approximately $V(C_1/C_1+C_2)$, which if the proper values are selected for $C_1$ and $C_2$, will apply a voltage across the display element 12 which is below threshold value and accordingly will remain unenergized or will become unenergized, depending upon its previous state of energization.

Figure 4:
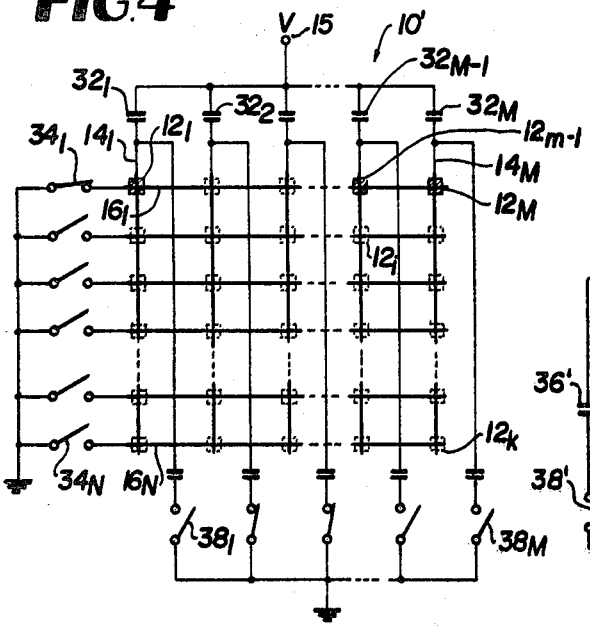
FIG. 4 is an electrical schematic diagram of a matrix display shown in FIG. 1 incorporating the drive circuit shown in FIG. 3.

Such a drive scheme can be applied to the M×N display matrix as shown in FIG. 1 by connecting each row electrode $16_1 \ldots 16_N$ to respective switching elements $34_1 \ldots 34_N$ and each column electrode $14_1 \ldots 14_M$ to respective switching elements $38_1 \ldots 38_M$. Accordingly, a matrix configuration such as shown in FIG. 4 would result having series capacitors $32_1 \ldots 32_M$ which would be coupled in series to the column electrodes $14_1 \ldots 14_M$. As for the parallel capacitor 36, the column electrodes $14_1 \ldots 14_M$ would have respective capacitors $36_1 \ldots 36_M$ coupled to respective column select switch elements $38_1 \ldots 38_M$. Thus by the selective closure of any $i_{th}$ row switch $34_i$, the $i_{th}$ electroluminescent display element $12_i$ will become energized but thereafter on the closure of the $i_{th}$ column select switch element $38_i$, it will become deenergized.

Figure 5:
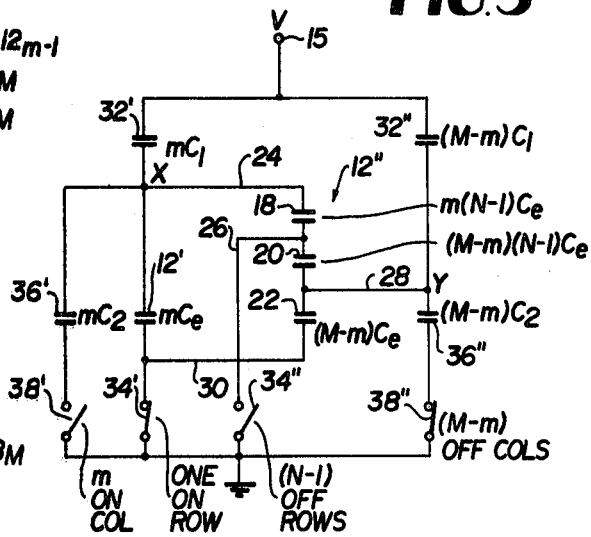
FIG. 5 is an electrical schematic diagram of the equivalent circuit for the matrix configuration shown in FIG. 4.

Such a matrix configuration results in an equivalent circuit such as shown in FIG. 5 which is similar to the equivalent circuit shown in FIG. 2 but is complicated by the presence of the capacitances $C_1$ and $C_2$. In FIG. 5 the row select switches 34' and 34'' represent the switching elements for one "on" row and the remaining (N−1) "off" rows while the switches 38' and 38'' represent the number of switch elements for m "on" columns and the number of switch elements of the (M−m) "off" columns. The capacitance $mC_e$ represents the capacitance of m elements 12' in a particular "on" row, while reference numeral 12'' as before denotes the combined capacitance of the unenergized display elements consisting of three series connected capacitors 18, 20 and 22. Maintaining the same convention with respect to the capacitance $C_1$ and $C_2$, reference numeral 32' denotes the $mC_1$ capacitance connected to the energized display elements 12' while reference numeral 32'' denotes the remainder of the $(M-m)C_1$ capacitance. Likewise, reference numeral 36' denotes the $mC_2$ parallel capacitors associated with the "on" display elements 12' while reference numeral 36' denotes the $C_2$ capacitors connected to the columns of the off elements 12''.

Analysis of the equivalent circuit of FIG. 5 using well known Y−Δ transformations provides voltage division at point x and point y for the "on" display elements 12' and the (M−m) off display elements 12'' and according to the following equations:

$$V_x = V\frac{C_1}{C_1 + C_e + \left[\left(1 - \frac{m}{M}\right)(N-1)\left(\frac{C_2C_e}{C_1 + C_2 + NCe}\right)\right]}$$

and $$V_y = V\frac{C_1}{C_1 + C_2 + C_e - \left[\left(\frac{m}{M}\right)(N-1)\left(\frac{C_2C_e}{C_1 + NC_e}\right)\right]}$$

Again by selecting the proper values of $C_1$ and $C_2$ for the capacitors $32_1 \ldots 32_M$ and $36_1 \ldots 36_M$ an adequate operating margin for any number of m elements is provided.

Figure 6:
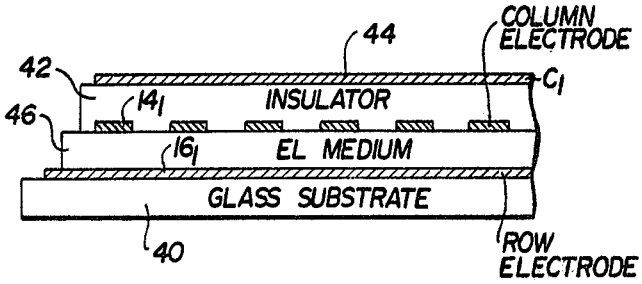
FIG. 6 is a partial cross sectional view of a display panel having a thin film electroluminescent matrix thereon.

Due to the fact that all of the $C_1$ capacitors $32_1 \ldots 32_M$ of FIG. 4 are commonly connected to the supply voltage V, in an electroluminescent panel configuration wherein the row and column electrodes $16_1 \ldots 16_M$ and $14_1 \ldots 14_M$ are fabricated as transparent electrodes on a glass substrate 40 as shown in FIG. 6, the $C_1$ capacitors can be fabricated directly on the panel structure as a composite circuit element by depositing an insulating layer 42, for example, over the M column electrodes 14 and then applying transparent electrode material in a layer 44 over the insulating layer 42. The capacitance $C_1$ to each column electrode 14 will then be proportional to $mC_3$ but since M for most current display applications is of the order of 100 to several hundred, the proper magnitude for $C_1$ will be provided. In any event, the exact value can be tailored by the thickness of the insulated layer 42. With both the column electrodes 14 and the row electrodes 16 comprising the transparent electrodes formed on the back of a glass substrate 40 with an electroluminescent medium 46 therebetween, a relatively simple display panel and drive circuit therefor can be implemented by means of current state of the art techniques for fabricating integrated circuits.

Figure 7:
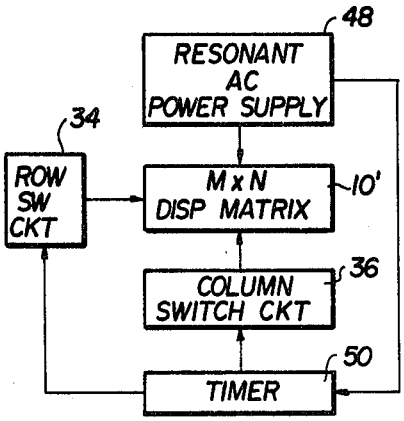
FIG. 7 is an electrical block diagram generally illustrative of a configuration for powering the matrix configuration shown in FIG. 4 by a resonant power supply.

Because of the totally capacitive nature of the drive and display circuitry shown for example in FIG. 4, it readily lends itself to being powered by a resonant supply circuit to realize a savings in input power. Such an arrangement is shown in FIG. 7 wherein the display matrix 10' shown in FIG. 4 is coupled to a resonant AC power supply 48 with the row switch circuit 34 and the column switch circuit 36 being controlled by a timer 50 which operates to provide switching signals to control the various switching elements in synchronism with the zero cross-over, for example, of the resonant voltage of the power supply 48. This is particularly applicable since the switching elements $32_1 \ldots 32_M$ and $34_1 \ldots 34_N$ can, when desirable, be in the form of conventional transistors, field effect transistors, triacs or other semiconductor elements suitable for operating as an electrical switch.

Having thus shown and disclosed what is at present considered to be the preferred embodiment of the subject invention, the same has been made by way of illustration and not limitation. Accordingly all modifications, alterations and changes coming within the spirit and scope of the invention are herein meant to be included.

What is claimed is:

1. A drive circuit for light emissive elements electrically energizable from an electrical source of power, comprising in combination:

at least one light emissive element having an electrical capacitance of a predetermined value;

first electrical capacitive means having a capacitive value relatively greater than the capacitance value of said light emissive element;

first electrical switch means being operable in one of two operating states to couple said at least one light emissive element in series circuit relationship with said first electrical capacitance means across said source of power whereby a capacitive voltage divider action occurs to apply a voltage of sufficient magnitude across said light emissive element to energize said element;

second electrical capacitance means also having a capacitance value relatively greater than the capacitance value of said light emissive element; and second electrical switch means being operable in one of two operating states to couple said second electrical capacitance means in parallel circuit relationship with said light emissive element whereby a capacitive voltage divider action occurs to apply a voltage of insufficient magnitude across said light emissive element to energize said element when said first switch means is also in its said one operating state.

2. The drive circuit as defined by claim 1 wherein said at least one light emissive element comprises a thin film electroluminescent device.

3. The drive circuit as defined by claim 2 wherein said thin film electroluminescent device comprises one element of a matrix display.

4. The drive circuit as defined by claim 3 wherein said electrical source of power comprises a resonant power supply providing an alternating current drive voltage across said at least one light emissive device, and additionally including circuit means for operating said first and second electrical switch means in synchronism with said resonant power supply.

5. The drive circuit as defined by claim 1 wherein said at least one light emissive element comprises one element of a matrix display including a plurality of rows and columns of light emissive elements.

6. The drive circuit as defined by claim 1 and additionally including a plurality of light emissive elements as well as said at least one light emissive element, said elements being respectively formed at the crossing of plural rows and columns of electrodes separated by an electroluminescent medium and wherein said first electrical switch means are coupled to a like plurality of electrodes of said rows and columns of electrodes, and wherein said second electrical switch means and said first and second electrical capacitance means are coupled to the other like electrodes of said plurality of rows and column electrodes.

7. The drive circuit as defined by claim 6 wherein said first electrical switch means is coupled to said plurality of row electrodes, and wherein said second switch means and said first and second electrical capacitance means are coupled to said plurality of column electrodes.

8. The drive circuit as defined by claim 6 wherein said first and second switch means comprise individual switch elements coupled to respective row and column electrodes.

9. The drive circuit as defined by claim 8 wherein one of said individual switch elements coupled to a specific row electrode of said row and column electrodes is in a closed operating state and wherein a selected number of switch elements coupled to said column electrodes are in an open operating state to energize a specified number of elements of the row and wherein the remainder of said switch elements couples to said column electrodes are closed to deenergize the remainder of said light emissive elements of the row, and whereby the unenergized row and column electrodes are adapted to float electrically in relation to the energized elements.

10. The drive circuit as defined by claim 9 and wherein said electrical source of power comprises a resonant AC power supply.

11. The drive circuit as defined by claim 10 wherein said first electrical switch means coupled to said plurality of row electrodes and said second electrical switch means coupled to said plurality of column electrodes include means for being synchronously operated in relation to the voltage supplied by said resonant AC power supply.

12. The drive circuit as defined by claim 6 wherein said plurality of row and column electrodes are fabricated on a transparent substrate to provide a display panel.

13. The drive circuit as defined by claim 12 wherein at least one whole electrode set of said column and row electrodes is comprised of transparent electrodes and additionally including outer electrode means formed over said row and column electrodes and being insulated therefrom to provide said first electrical capacitance means directly on said panel.

14. The drive circuit as defined by claim 6 wherein said first and second electrical switch means respectively coupled to said row and column electrodes are comprised of semiconductor switch elements.

* * * * *